US005232299A

United States Patent [19]

Hiss

[11] Patent Number: 5,232,299

[45] Date of Patent: Aug. 3, 1993

[54] PARTS WASHER

[75] Inventor: Keith W. Hiss, Monkton, Md.

[73] Assignee: Better Engineering Mfg., Inc., Baltimore, Md.

[21] Appl. No.: 917,586

[22] Filed: Jul. 21, 1992

[51] Int. Cl.[5] ..... B08B 3/02

[52] U.S. Cl. ..... 401/143; 134/104.4; 134/199; 134/200; 401/146

[58] Field of Search ..... 134/104.2, 104.4, 111, 134/199, 200; 401/143, 146

[56] References Cited

U.S. PATENT DOCUMENTS

| | | | |
|---|---|---|---|
| 2,653,617 | 9/1953 | Zaber . | |
| 2,904,265 | 9/1959 | Lyman | 134/111 X |
| 3,405,720 | 10/1968 | Carlson | 134/199 X |
| 3,452,763 | 7/1969 | Ballard . | |
| 3,624,750 | 11/1971 | Peterson | 134/104.2 X |
| 4,038,155 | 7/1977 | Reber | 134/200 X |
| 4,056,114 | 11/1977 | Boutillette | 134/111 X |
| 4,744,379 | 5/1988 | Goettel | 134/200 X |
| 5,107,876 | 4/1992 | Ozyjiwsky | 134/111 |

FOREIGN PATENT DOCUMENTS

| | | | |
|---|---|---|---|
| 2305906 | 8/1974 | Fed. Rep. of Germany | 134/199 |

OTHER PUBLICATIONS

Tempest TM High Pressure Spray Cabinet, Product Literature, 2 pages.

Intercont Products, Inc., Springfield, Mo., Product Literature for "Parts Cleaner Model ST-1/St-2".

Safety-Kleen Corporation's Advertisement from Engineer's Digest, Jan. 1992, p. 35.

Better Engineering Mfg., Inc., Baltimore, Md., Product Literature for "Jet Washing", 1988.

*Primary Examiner*—Philip R. Coe

*Attorney, Agent, or Firm*—Sterne, Kessler, Goldstein & Fox

[57] ABSTRACT

A recirculating parts washer provides both automatic jet washing and manual, sink-type brush washing for automotive parts and the like. The parts washer, which uses a water-based detergent cleaning solution, comprises a tank for storing a cleaning solution, a housing for providing an enclosed wash area, a jet wash means providing automatic jet washing, a brush wash means allowing manually cleaning, and a pump means for selectively delivering a flow of cleaning solution to the jet wash means and/or the brush wash means. A means for decontaminating the cleaning solution and the tank is also provided.

9 Claims, 7 Drawing Sheets

PARTS WASHER

BACKGROUND OF THE INVENTION

1. Field of the Invention

This invention relates generally to parts washers used for cleaning and degreasing automotive parts and the like. More specifically, the invention relates to parts washers which use a water-based cleaning solution for degreasing and general cleaning of parts.

2. Related Art

In garages, machine shops, tool shops, manufacturing plants and the like, there are greasy, grimy, oil and otherwise contaminated parts that need to be cleaned. Most businesses use petrochemical solvents to clean such parts. The most common solvent-based parts washer is the sink-type washer.

The standard sink-type parts washer (or simply "solvent sink") uses a recirculated solvent which is dispensed from a spigot as an operator hand brushes a part being cleaned. The brush may be attached to the spigot so that the solvent may be delivered through the brush while the part is scrubbed. This type of parts washer can be found in nearly every automotive service station in the United States. Automobile dealers may have five, ten or even twenty of these solvent sinks. Factories which have numerous areas requiring occasional parts cleaning may have 100 or more solvent sinks. Safety-Kleen Corporation of Elgin, Ill., is a principal supplier of solvent-based sink-type parts washers.

Through the years, the solvent sink has served its purpose well, and while it is still in full use, it has become outdated. Handling and disposal of contaminated solvents is strictly regulated due to environmental concerns. Further, working with solvents poses a health threat to workers. These concerns are forcing businesses to reduce, if not curtail, their use of solvents.

Frantically, businesses are trying to replace their solvent-based parts washers with water-based models. Unfortunately, a water-based parts washer which will adequately replace the solvent sink is not available. To understand why a suitable replacement is not available, it is important to understand how the solvent sink is used and what alternatives are available for each use.

Essentially, there are two parts washers available which use a water-based cleaning solution: the automatic jet washer and the water-based sink-type parts washer. Each is discussed in detail below.

Automatic Jet Washer

Automatic jet washing is one alternative to washing parts with a solvent sink. While solvents are the popular choice for sink-type washers, solvents are generally not used for jet washing. This is because spraying a solvent results in large solvent losses through evaporation. Further, the atomized solvents are generally highly flammable and present an increased health hazard to workers. Thus, jet washers normally clean with a water-based detergent solution. The water-based detergent solution is heated to enhance its cleaning abilities.

The sizes, shapes and configurations of jet washers are as different and varying as the parts washed in them. These range from very large enclosed conveyor-type washers found in the assembly lines of large factories down to the mobile, cabinet-type washers which might be found in a small machine shop. Depending on the particular application, the washers may have pump/-spray systems that clean using high-pressure, low volume; medium pressure, medium volume; or low-pressure, high volume spraying. Notwithstanding their eclectic nature, most jet washers have certain standard elements.

Essentially, the standard jet washer comprises a wash housing, a support (e.g., a basket or turntable) in or on which the parts to be cleaned are placed, and one or more spray manifolds. In an attempt to achieve 100% cleaning in a wide range of applications, the jet washer is designed for maximum spray impact. Spray nozzles on the spray manifolds emit a relatively narrow, high impact spray pattern and either the parts rotate through the spray pattern or the spray manifolds rotate around the parts.

As effective as jet washers and other types of automatic, water-based cleaning methods are, they have not significantly reduced the usage of solvent sinks for several reasons. Foremost among these:

1. Automatic washers are too expensive, especially for small companies.

2. Automatic systems such as jet washers are too large for many applications. Often, there is not enough room to put a jet washer in an area which currently accommodates a solvent sink.

3. Jet washers do not allow hand cleaning of parts. Some parts are too small or too sensitive to use jet washing, or are too dirty or too intricate to exclusively use jet washing.

Since the jet washer is not capable of replacing the solvent sink, the current practice in the industry is to purchase both a jet washer and a solvent sink. The jet washer is used to perform the majority of the parts cleaning work. Thereby, automating a labor intensive task. Any additional hand cleaning which is required is performed manually in a solvent sink. Thus, for optimal cleaning, a user is required to purchase two parts washing units: an automated jet washer and a sink-type parts washer.

This is a costly proposition. For smaller businesses (e.g., machine shops, automotive service stations, small production shop, etc.), the cost and floor space required by both a jet washer and a sink-type washer is often prohibitive. For these reasons, small businesses often perform all parts cleaning manually in a sink-type washer.

The M-30 jet washer available from Better Engineering Mfg., Inc. of Baltimore, Md., is an example of an automatic jet washer. This type of jet washer is often combined with a sink-type parts washer such as a Model 16 or Model 30 from Safety-Kleen Corporation. These Safety-Kleen solvent sinks have enjoyed considerable commercial success.

Small Automatic Jet Washer

Generally, the sink-type washers are much smaller than the jet washers. This results from the fact that thorough jet washing requires that a relative motion be imparted between the parts being cleaned and the streams (jets) of cleaning liquid which are sprayed onto the parts. As explained above, this relative motion is often implemented with a rotating turn-table or basket upon which the parts are placed. Rotation requires that the smallest dimension of the cleaning area in the plane of rotation be at least as large as the largest dimension of the part to be rotated in that plane. For example, if an automobile cylinder head having dimensions of 27"×7"×6" is to be rotated in a parts washer; then the washer must normally have a wash area which is, say, 28"×28". (Note that such parts are normally not stood on end in the wash area.) With a sink-type washer, such a cylinder head could be cleaned in a wash area of approximately 28"×7" since rotation is not required.

Jet washers, which are being marketed for small business applications, are produced in sizes much smaller than the large industrial jet washers. However, these smaller jet washer are still unable to approach the small size of the sink-type washers due to the rotation problem discussed above. Further, these small units still do not provide complete cleaning. Therefore, even if a small business were to purchase a small jet washer, a sink-type washer would still be required to meet all of the business's cleaning needs. Rather than purchase two cleaning units, many small businesses opt to continue cleaning parts manually in a sink-type parts washer.

Water-Based Sink-Type Parts Washer

A water-based version of the sink-type parts washer is currently available. This parts washer is virtually identical to the solvent sink except that a heating element and thermostat are added to the reservoir to heat the cleaning solution. Water-based cleaning solutions, however, do not clean as well as a solvent. Therefore, an operator is forced to spend proportionally more time, a prohibitive amount of time, scrubbing the part. For this reason, the water-based sink-type parts washer has not supplanted the solvent sink.

Other Solvent-Based Parts Washers

In the past, numerous attempts have been made to develop a parts washer which provides both manual and automatic cleaning. Several of these are discussed here to illustrate known cleaning schemes. Each employs a petrochemical solvent to perform the cleaning. While these parts washers are not applicable to the problem at hand, they illustrate the variety of solvent washing schemes.

U.S. Pat. No. 2,653,617 to Zaber and U.S. Pat. No. 4,056,114 to Boutillette each disclose sink-type parts washers having two modes of cleaning. In a first cleaning mode, a flexible hose is used to deliver a cleaning solvent to a part for manual cleaning. In a second cleaning mode, the parts are placed in a solvent bath and the solvent is agitated by compressed air which is released into the solvent bath via a perforated tube. In the case of the Zaber patent, further agitation of the solvent bath may be affected by a horizontal solvent stream and a vertical solvent stream which are directed to the solvent by fluid conduits disposed within the wash tank. Solvent agitation is not as effective as jet washing. As a result, parts washers which use an agitated-solvent cleaning process are not in widespread use.

Another example of a parts washer providing multiple cleaning modes is disclosed in U.S. Pat. No. 5,107,876 to Ozyjiwsky. The Ozyjiwsky patent is primarily directed to enhancing the filtering of a cleaning solvent such that its useful life is extended. The Ozyjiwsky patent discloses several means for applying cleaning solution to a part. The cleaning solution may be applied via a hand-held brush, a hand-held jet spray, or a spray distribution conduit.

The hand-held brush and the hand-held jet spray are for manual parts cleaning. The spray distribution conduit appears to provide a spray or shower for manually rinsing parts. While several solvent delivery means are disclosed, Ozyjiwsky does not provide an automatic mode of parts washing.

In summary, there exists a need for a water-based parts washer which can replace the conventional solvent sink. There further exists the need for a compact parts washing unit which will meet the cleaning needs of both small and large businesses alike and will eliminate the need to purchase two pieces of cleaning equipment. At one end of the spectrum of known water-based parts cleaners is the automatic jet washer, which because of size, cost, and the lack of a manual or hand cleaning mode can't replace the solvent sink. At the other end of the spectrum is the water-based sink which cannot supplant the solvent sink because the labor expenditure is too high.

SUMMARY OF THE INVENTION

The present invention is a hybrid parts washer which uses a water-based biodegradable detergent solution for cleaning and degreasing automotive parts and the like. The washer has two modes of operation: an automatic jet wash mode and a manual brush wash mode.

The washer includes a base, a wash housing, and a lid. A cover plate disposed within the wash housing separates the wash housing into a wash area and a tank. A work shelf is located in the wash area for supporting parts during the cleaning process.

A jet wash assembly provides the jet wash feature to the washer. The jet wash assembly includes a first "U" shaped spray manifold, a second "U" shaped spray manifold and a large pump. The first spray manifold is mounted on the inside of the lid. The second spray manifold is disposed in the wash area between the cover plate and the work shelf. The large pump delivers the cleaning solution from the tank to the spray manifolds. Each spray manifold includes a plurality of jet spray nozzles (each providing a solid conical spray pattern) for directing a total coverage flow of cleaning solution to a workpiece.

A brush wash assembly provides the brush wash feature to the washer. The brush wash assembly includes a scrub brush, a hose, and a small pump. The hose connects the brush to the small pump. The small pump delivers the cleaning solution from the tank to the brush for manual application to the parts.

This invention, by combining the two concepts of automatic cleaning and manual cleaning with a water-based solution, can and will replace the conventional solvent sink. If the parts are only covered with light oils, there will be no need to utilize the hand brush. If the parts are 95% cleansed by the automatic cycle, the brush wash mode may be used to finish the job. If the contaminants are very difficult to remove, the automatic cycle will at least loosen the contaminants so that it is easier to hand clean the parts.

At its best, this invention will altogether alleviate the need for hand (manual) cleaning. At its worst, this invention will replace the solvent sink and allow cleaning of parts without the use of hazardous petrochemical solvents.

The water-based cleaning solution of the invention is not inherently hazardous like a solvent. However, the contamination removed from parts may render the solution unacceptable for sewage disposal. In this is the case, the cost to dispose of the contaminated water may be as high as the disposal cost for hazardous solvents. Accordingly, the present invention provides a means for periodically decontaminating the cleaning solution (i.e., removing oils, greases, sludge, etc.) such that the majority of the solution never requires disposal.

It is an advantage of the invention that a single, compact parts washer can provide both automatic jet washing and manual sink-type parts washing. This is a savings in both floor space and money for applications which heretofore required the purchase of both a jet washer and a solvent sink.

It is another advantage of the invention that all washing is performed without the use of solvents. Cleaning is performed with a water-based, biodegradable detergent cleaning solution.

It is a further advantage of the present invention that a means for cleaning and recycling the cleaning solution is provided.

It is yet another advantage of the invention that the hybrid parts washer is roughly the same size as the Safety-Kleen solvent sink.

DESCRIPTION OF THE PREFERRED EMBODIMENT

Figure 1:
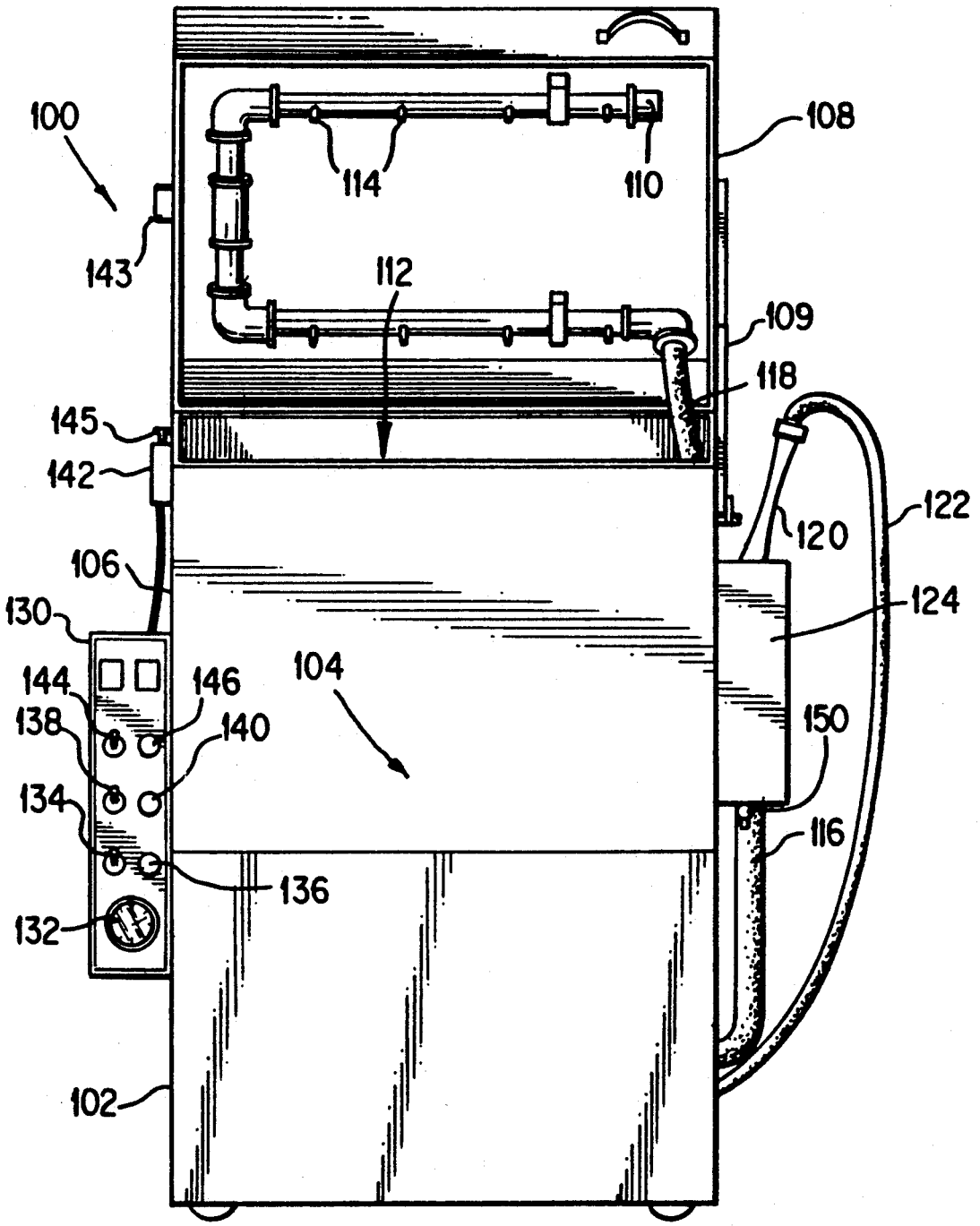
FIG. 1 is a front view of the hybrid parts washer of the invention depicted with the lid open.

The invention is a parts washer which integrates the advantages of a jet washer with the advantages of a sink-type parts washer to produce a hybrid parts washer. The hybrid parts washer of the invention will, for many users, replace the conventional jet washers and solvent sinks currently in use. Further, since the hybrid washer uses a water-based detergent cleaning solution, the hazardous waste disposal problems of the user will be greatly reduced. These features are provided in a parts washer of reduced size and cost. It is anticipated that the hybrid washer of the invention will revolutionize the parts cleaning industry.

The invention is now described in detail with reference to the drawings, where like reference numbers indicate like elements. Note that three digit reference numbers are used throughout the drawings. The leftmost digit represents the drawing number in which the particular element is first shown.

Figure 2:
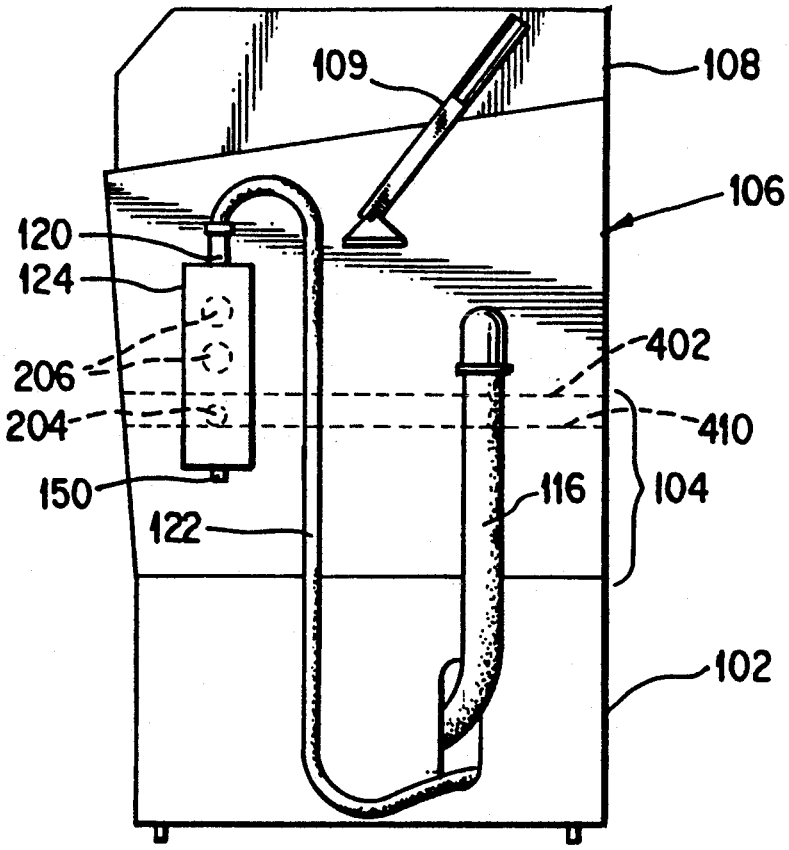
FIG. 2 is a right side view of the hybrid parts washer of the invention.
Figure 3:
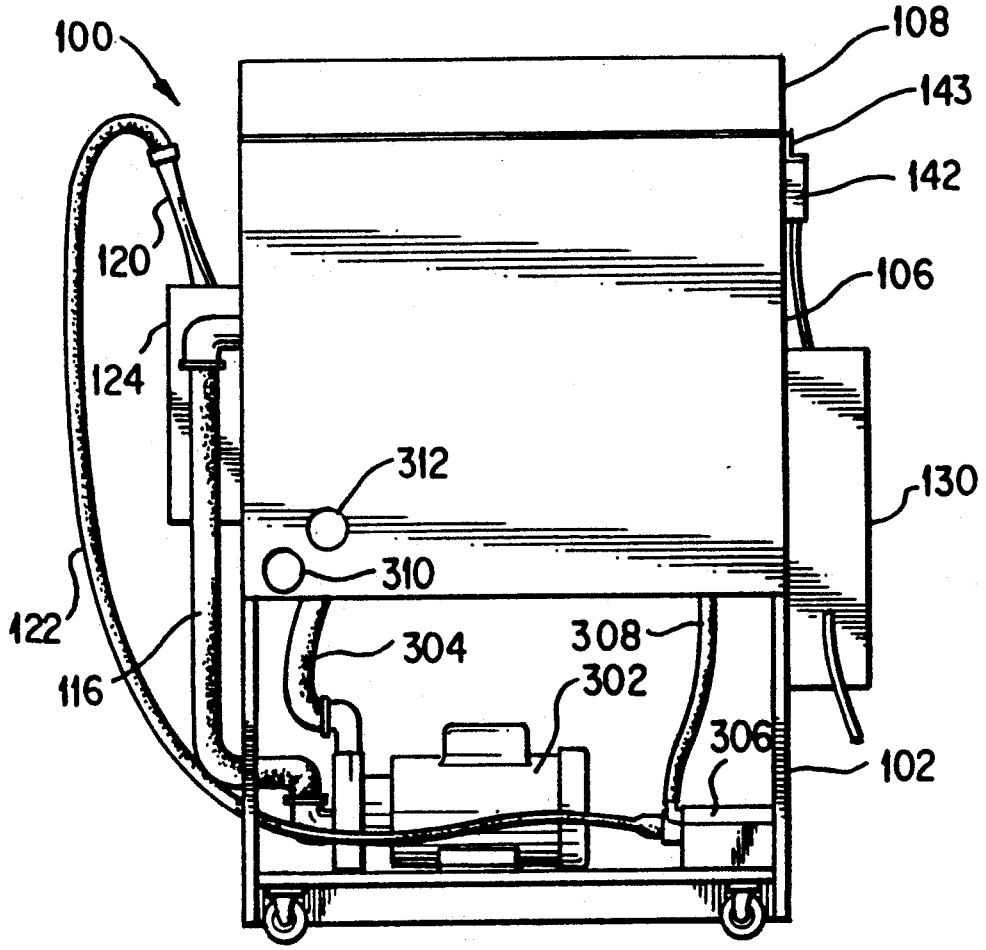
FIG. 3 is a rear view of the hybrid parts washer of the invention.

Hybrid parts washer 100 is shown in FIGS. 1-3. Washer 100 includes a base 102, a wash housing or enclosure 106 and an access cover or lid 108. Base 102 supports wash housing 106 at a suitable working height off of the floor. Lid 108 is coupled to housing 106 via a hinge (not shown) and a lid support 109. Housing 106 and lid 108 define an enclosed wash area 112 and a tank 104. Tank 104 consists of a lower portion of housing 106 which is adapted to store a cleaning solution. Wash area 112 consists of a portion of housing 106 above tank 104 and below lid 108.

Figure 4:
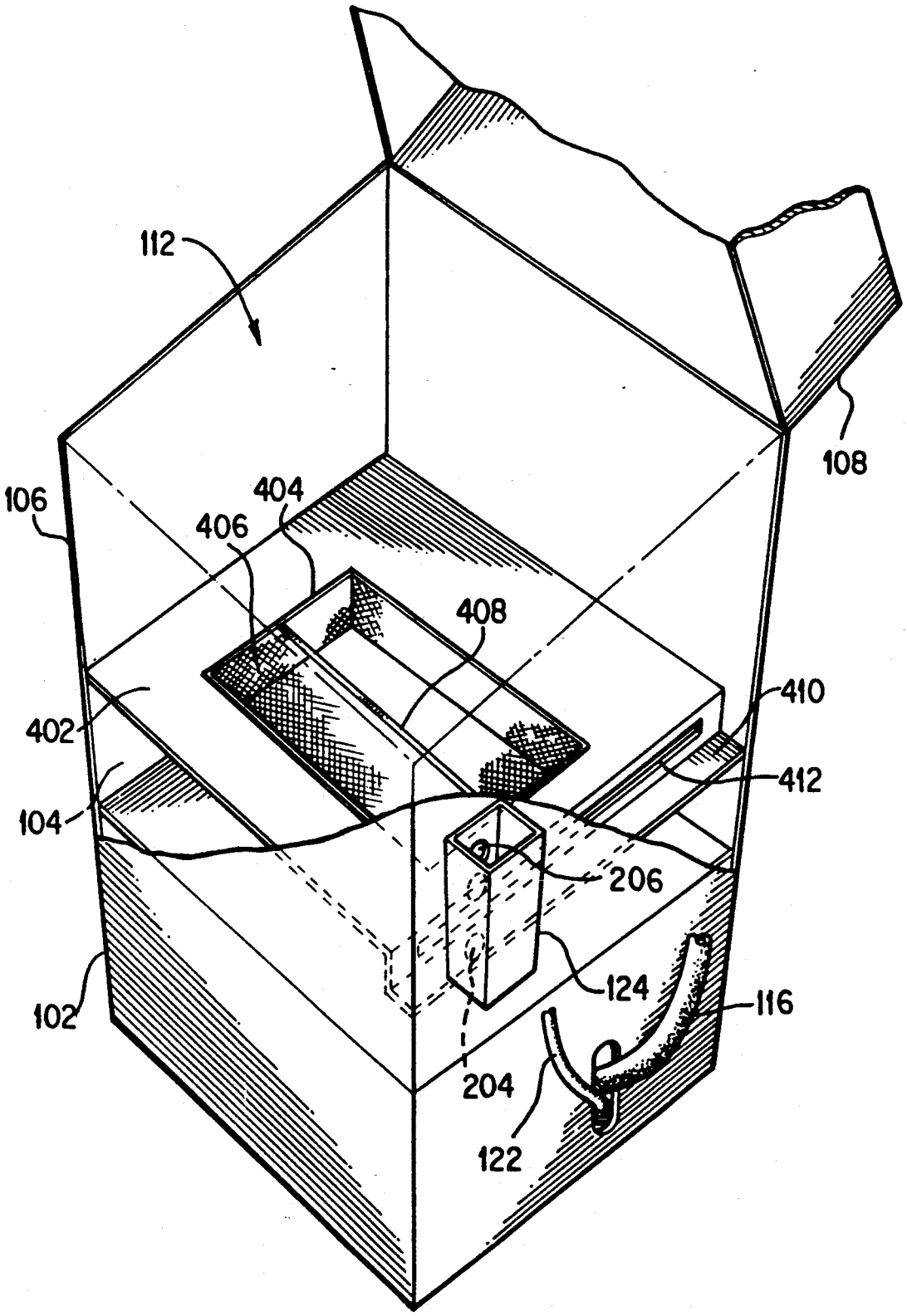
FIG. 4 is a cutaway, perspective view of the hybrid parts washer of the invention illustrating the cover plate and the filter basket.
Figure 5:
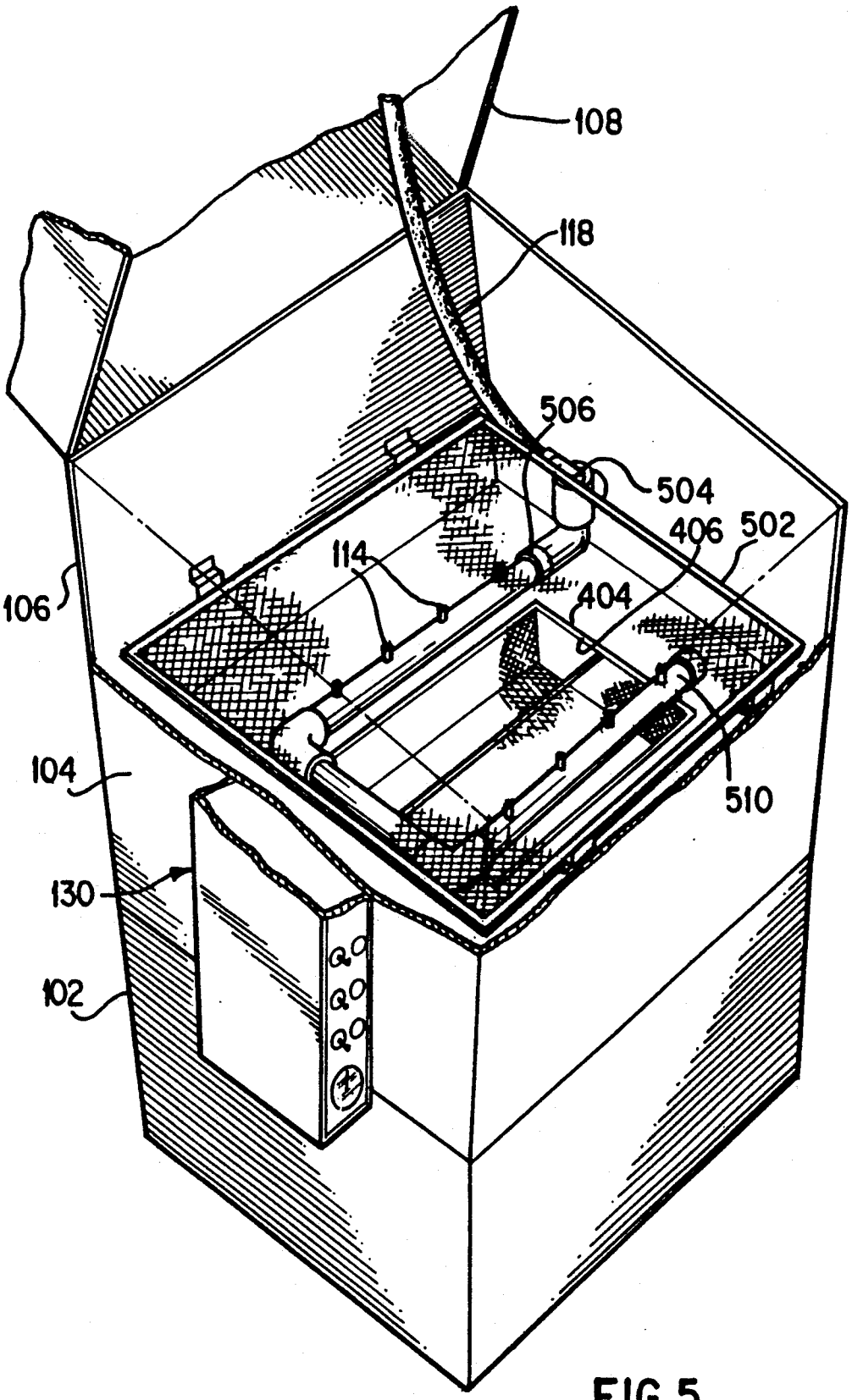
FIG. 5 is a cutaway, perspective view of the hybrid parts washer of the invention illustrating the work shelf and lower spray manifold.

Referring now to FIGS. 4 and 5, the inner structure of parts washer 100 is described. A cover plate 402 separates wash area 112 from communication with tank 104 except through a return opening 404. A filter basket 406 is disposed in return opening 404. Filter basket 406 includes a handle 408 to allow easy removal of filter basket 406 for cleaning. A work shelf or grate 502 is disposed within wash area 112 above cover plate 402.

A jet wash assembly provides a jet wash feature to washer 100. The jet wash assembly includes a first "U" shaped spray manifold 110, a second "U" shaped spray manifold 510 and a pump 302. Manifold 110 is mounted on the inside of lid 108. Manifold 510 is disposed in wash area 112 between cover plate 402 and work shelf 502 and rests on cover plate 402. Each manifold 110,510 includes a plurality of jet spray nozzles 114. Each jet spray nozzle 114 provides a solid conical spray pattern.

A hose 304 connects the intake port of pump 302 to a tank outlet (not shown). The tank outlet extends upward into tank 104 (e.g., two inches above the tank bottom) to allow cleaning solution to be withdrawn therefrom. A hose 116 connects the outlet port of pump 302 to a "T" fitting 504 in wash area 112. "T" fitting 504 is connected to "U" shaped manifold 510 via a rotatable coupling 506 and to "U" shaped manifold 110 via a hose 118.

A brush wash assembly provides a brush wash feature to washer 100. The brush wash assembly includes a scrub brush 120, a hose 122 and a pump 306. Hose 122 connects brush 120 to pump 306. A brush box 124 provides a holder for brush 120 when it is not being used. As discussed below, brush box 124 also performs the features of venting steam from the washer and of catching waste oils, greases and other lighter than water contaminants removed from washer 100 in a washer cleaning or decontamination step.

A hose 308 connects the intake port of pump 306 to a second tank outlet. The second tank outlet extends upward into tank 104 (e.g., two inches above the tank bottom) to allow cleaning solution to be withdrawn therefrom. The outlet port of pump 306 is connected directly to hose 122 of the brush assembly.

An electrical control panel 130 couples with local electrical service and provides electrical power distribution and control for washer 100. This includes providing power to a heating element (not shown) which is located inside tank 104. The heating element heats the cleaning solution to a temperature selected using thermostat 132. The heating element is further controlled via ON/OFF switch 134, having an indicator light 136.

An ON/OFF switch 138, having an indicator light 140, controls power to pump 302. An interlock (i.e., switch) 142 connected to electrical control panel 130 prevents pump 306 from being operated unless lid 108 is in a CLOSED position. When lid 108 is in a CLOSED position, a strike plate 143 depresses a plunger 145 of interlock 142. An ON/OFF switch 144, having an indicator light 146, controls power to pump 306.

These features of washer 100 provide two modes of operation: a jet wash mode and a brush wash mode. Each mode of operation is now described in detail.

Jet Wash Mode

Figure 6:
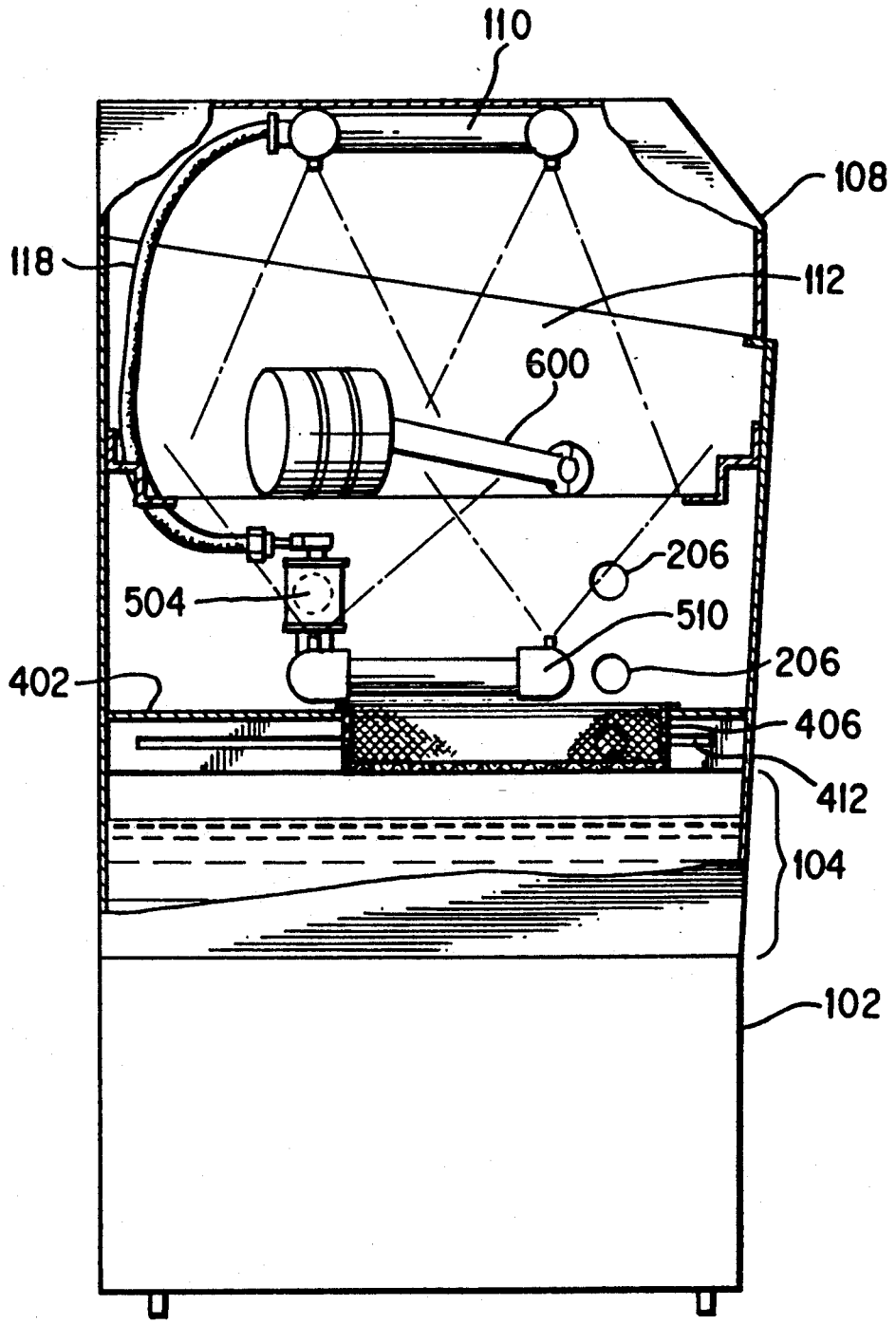
FIG. 6 is a cross-sectional left side view of the hybrid parts washer of the invention illustrating operation of the jet wash mode.

In the jet wash mode, illustrated in FIG. 6, a part 600 (e.g., a piston and connecting rod assembly) to be cleaned is placed on shelf 502 in wash area 112. Lid 108 is then closed so that wash area 112 is enclosed. Switch 138 is then toggled to the ON position. This causes pump 302 to pump cleaning solution from tank 104 and deliver it, under pressure, to spray manifolds 110,510. The cleaning solution then exits jet spray nozzles 114 and falls upon part 600.

The cleaning solution lifts, mixes with and removes oils, greases, dirts, metal chips and other contaminants from part 600 before flowing by gravity through shelf 502 and into the lower portion of wash area 106. The cleaning solution is then forced, by cover plate 402, to flow through basket 406 (which is located in opening 404) and back into tank 104. Basket 406 filters the cleaning solution to prevent large particles from entering tank 104.

Conventional jet washers utilize a plurality of "V" jets to produce a straight line spray pattern through which the part is rotated. Each "V" jet produces a two dimensional "V" shaped spray pattern. The cleaning solution impacts directly on the surfaces of the part which is rotated through the spray pattern. This is a "high impact" cleaning method.

Hybrid washer 100 provides automatic cleaning, in the jet wash mode, without rotating the part. Spray jets 114 are arranged on spray manifolds 110,510 such that the solid conical spray patterns of adjacent jets 114 overlap to produce a full coverage spray pattern. This full coverage spray pattern, while not directly impacting on every surface of a part, will provide complete jet wash cleaning.

It is anticipated that jet washing will normally remove, say, ninety percent of the contaminants sought to be washed from the part. Any additional cleaning that is required is performed in the brush wash mode of washer 100.

Brush Wash Mode

In the brush wash mode, a part to be cleaned is placed on shelf 502 in wash area 112. Lid 108 is left in the OPEN position, as shown in FIG. 1, so that wash area 112 is open to the user. Switch 144 is then toggled to the ON position. This causes pump 306 to pump cleaning solution from tank 104 and deliver it, under pressure, to brush 120 through hose 122. The cleaning solution exits a distal tip of brush 120 where the bristles are located. The user then uses brush 120 to scrub the part clean.

As the user scrubs the part, a constant flow of cleaning solution is delivered to the part through brush 120. The cleaning solution lifts, mixes with and removes oils, greases, dirts, metal chips and other contaminants from the part. The cleaning solution then flows off of the part, through shelf 502 and back into tank 104 through basket 406 as described above.

The brush wash mode is useful for cleaning very dirty parts (either before or after the jet wash mode is used), intricate parts, and delicate parts which cannot be jet washed. Further, the brush wash mode can be used for minor detailing of a slightly dirty part when the jet wash mode is not needed.

Figure 7:
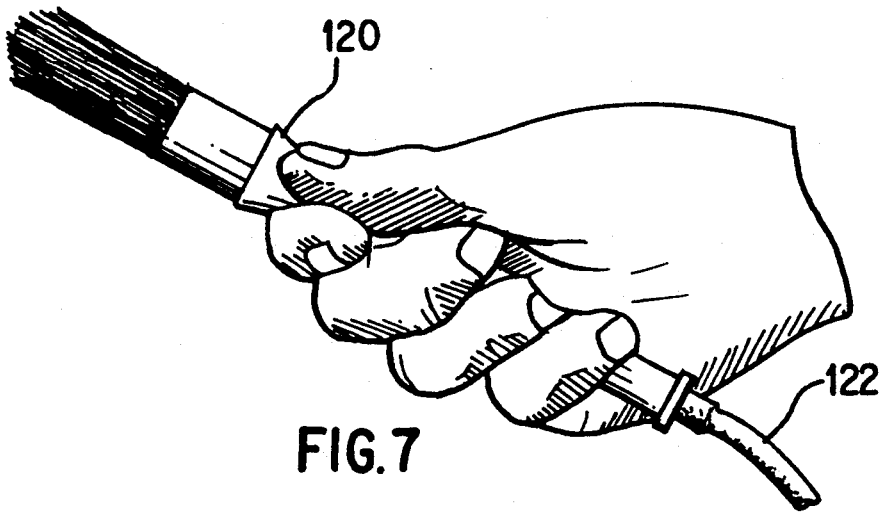
FIG. 7 depicts the parts washing brush and associated cleaning solution supply hose.

Brush 120 is illustrated in FIG. 7. In the preferred embodiment of the invention, brush 120 and hose 122 are combined in a Multijet Flow-through Parts Cleaning Brush, from the Parts Brush Division of PBC Co. of Vermillion, S. Dak. Pumps 302 is a series 30, 1"×¾" centrifugal pump, from MP Pumps, Inc. of Fraser, Mich. Pump 306 is a 200 Series, centrifugal pump from Gorman-Rupp Industries of Bellville, Ohio.

The inventor has discovered that the use of two pumps is preferred for washer 100. Pump 302 is a larger, high volume pump which supplies the cleaning solution to the plurality of jet spray nozzles 114. In the preferred embodiment, pump 302 supplies a nominal flow rate of twenty gallons per minute to spray manifolds 110,510. Pump 306 is a smaller, lower volume pump which supplies the cleaning solution to brush 120. In the preferred embodiment, pump 306 supplies a nominal flow rate of three gallons per minute to brush 120.

Figure 8:
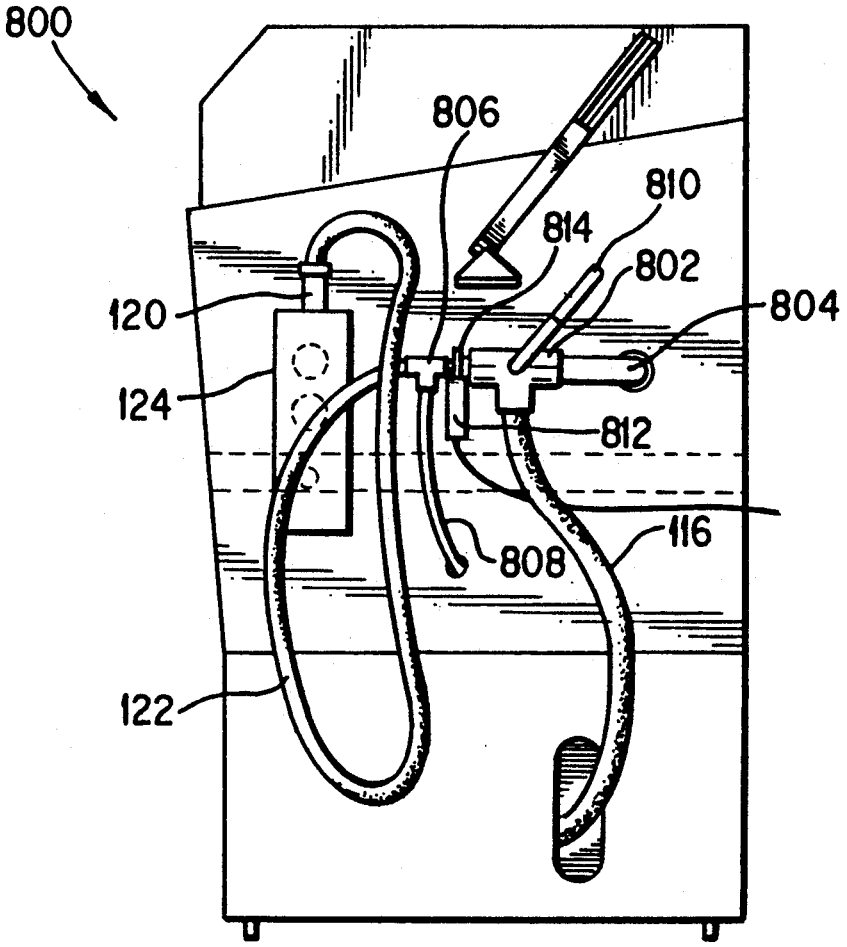
FIG. 8 is a right side view of an alternate embodiment of the hybrid parts washer of the invention.

In an alternate embodiment 808 of the invention shown in FIG. 8, pump 306 is eliminated and pump 302 is used to supply cleaning solution during both modes of washer operation. To accomplish this, a valve 802 is provided to selectively couple hose 116 (from the outlet port of pump 302) to manifolds 110,510 via a hose 804 (for jet washing) or brush 120 and hose 122 via T-connection 806 (for brush washing). In the brush wash mode, T-connection 806 diverts a portion of the cleaning solution from pump 302 and returns it to tank 104 through a hose 808. By bleeding off a portion of the flow in this manner, the volume of cleaning solution delivered to brush 120 is kept to an acceptable level.

In the preferred embodiment of washer 100, interlock 142 prevents pump 302 from being operated while lid 108 is open. This safety feature prevents a user from being sprayed in the face with cleaning solution. In alternate embodiment 800 of the invention, however, only one pump (pump 302) is used and must be operable with both the lid closed (for jet washing) and open (for brush washing). To accommodate this requirement and still provide a safety feature for the washer, a second interlock 812 is used.

Interlock 812 is positioned adjacent to valve 802 to cooperate with a valve actuator handle 810 of valve 802. When handle 810 is in a front position (pointing towards the front of the washer), pump 302 supplies cleaning solution to brush 120. In addition, when handle 810 is in the front position, it depresses a plunger 814 of interlock 812. When handle 810 is in a rear position (pointing towards the rear of the washer), pump 302 supplies cleaning solution to spray manifolds 110,510. Plunger 814 is not depressed when handle 810 is in the rear position.

Interlocks 142 and 812 work with electrical control panel 130 such that pump 132 is permitted to operate in only two circumstances. The first circumstance, or brush wash mode, occurs when interlock 142 is not depressed (lid 108 is open) and interlock 812 is depressed (handle 810 is in the forward position). The second circumstance, or jet wash mode, occurs when interlock 142 is depressed (lid 108 is closed) and interlock 812 is not depressed (handle 810 is in the rear position). As in the preferred embodiment 100 of the invention, this safety feature prevents a user from being sprayed in the face with cleaning solution.

During parts cleaning operations, the dirt, oils, greases and other contaminants removed from parts being cleaned will corrupt the cleaning solution in tank 104. Heavier than water contaminants will settle to the bottom of tank 104 and form a sludge. Lighter than water contaminants will float on top of the water-based cleaning solution. Both the cleaning solution and the tank must periodically be cleaned or decontaminated to remove these contaminants. Note that some oils may want to remain dispersed in the cleaning solution. However, using the proper detergent will allow approximately 98% of the waste oils to float on top of the cleaning solution rather than becoming dispersed therein. As set forth below, the preferred detergent is NATURAL ORANGE TM, which is available from Better Engineering Mfg., Inc.

The following features of washer 100 are provided to facilitate periodic tank cleaning: a lower drain 310, an upper drain 312, a trough 410 and a slot 412 formed in cover plate 402, an oil drain hole 204, and a petcock 150. Drains 310,312 are disposed in the back wall of tank 104. Drain 310 is a one inch I.D. (inner diameter) threaded hole which is centered approximately one-half inch above the tank floor such that the bottom of drain 310 is flush with the bottom of the tank. Drain 312 is a one inch I.D. threaded hole which is centered approximately one and one-half inches above the tank floor such that the bottom of drain 312 is one inch above the bottom of the tank. Normally, drains 310,312 are each sealed with a threaded plug.

Trough 410 is formed in cover plate 402 adjacent the right side of washer 100 (when viewed facing the washer as depicted in FIG. 4). Trough 410 is formed by bending cover plate 402 to form a two inch by two inch channel in cover plate 402 adjacent the right wall of housing 106.

Oil drain hole 204 is a one inch I.D. hole drilled through the right side wall of housing 106 such that the bottom edge of the hole is flush with the floor of trough 410. Brush box 124 is attached to the side of housing 106 such that hole 204 opens into brush box 124. Two vent holes 206, located in the right side of housing 106, also open into brush box 124. Vent holes 206 allow steam to escape from wash area 112. Slot 412 is milled into the vertical side of trough 410 one-half inch below the top of the trough (i.e., one and one-half inches above the floor of the trough).

Periodic cleaning of tank 104 includes the following four stages. First, oils and lighter than water contaminants are removed from the cleaning solution. Second, the cleaning solution is removed from the tank and kept for reuse. Third, the sludge is removed from the bottom of the tank. Finally, the cleaning solution is returned to the tank.

Figure 9:
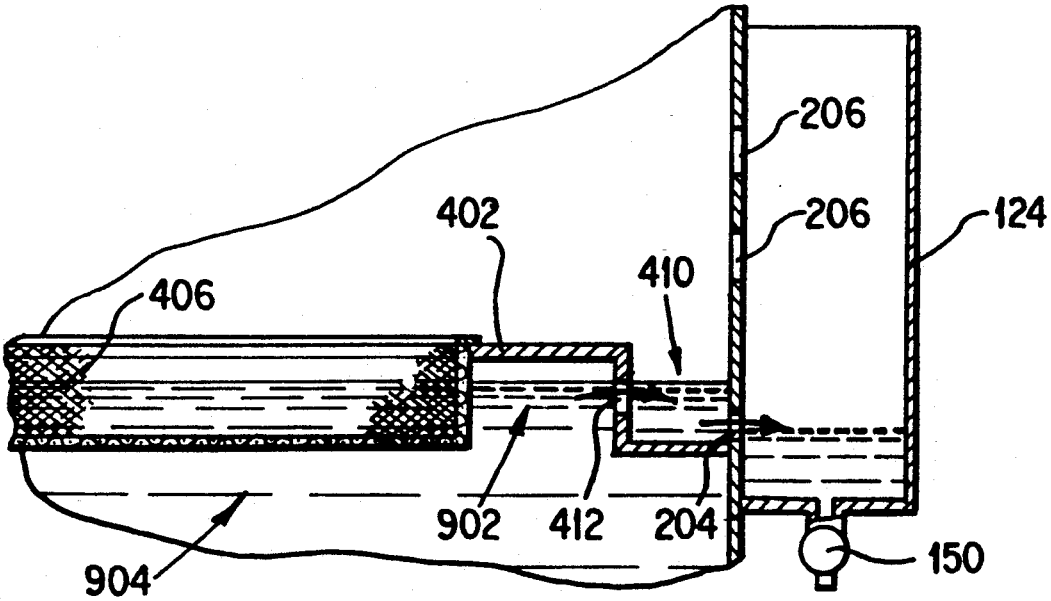
FIG. 9 is a partial cross-section of the hybrid parts washer illustrating operation of the means for removing oils and the like from the cleaning solution.

Specifically, periodic cleaning of tank 104 and the cleaning solution proceeds as follows. First, petcock 150 is opened to drain any cleaning solution present in brush box 124 and trough 410. Next, additional cleaning solution (or water) is added to the tank (e.g., by pouring through opening 404 from above) to raise the fluid level within the tank. As the fluid level is raised, all lighter than water contaminants floating on top of the cleaning solution will flow through slot 412 and into trough 410. From there, the contaminants drain through oil drain hole 204 into brush box 124. This is illustrated in FIG. 9 which shows a layer 902 of oil floating on top of the cleaning solution 904. Petcock 150 may be left open to drain the contaminants from the brush box for disposal.

Once all lighter than water contaminants have been removed, the plug is removed from upper drain 312 in washer housing 106 and the cleaning solution is drained from tank 104. Since the bottom of drain 312 is located one inch above the tank floor, however, not all of the cleaning solution will drain from tank 104. The remaining solution includes the sludge which has settled to the bottom of tank 104. The cleaning solution removed from drain 312, however, will normally be substantially free of contamination and is saved for reuse.

Next, the plug is removed from the lower drain 310. This allows the remainder of the solution in the tank to be drained. Because this remaining solution will likely be the most contaminated, it will normally be disposed of in a suitable manner. Thereafter, shelf 502 is removed and "U" shaped manifold 510 is rotated about coupling 506 to allow access to basket 406. Basket 406 is then removed using handle 408. An operator/user may then reach down into tank 104 through opening 404 to remove the remaining sludge from tank 104.

Once the cleaning process is completed, the washer is reassembled by replacing the plugs in drains 310,312, returning basket 406 into opening 404, rotating "U" shaped manifold 510 into a down position and replacing work shelf 502. The cleaning solution which was removed from the tank via upper drain 312 may then be returned to the tank through opening 404. Any additional cleaning solution necessary to fill the tank to a desired level may be added in a similar fashion. Washer 100 is then ready to resume wash operations.

The preferred cleaning solution for washer 100 is water with an alkaline detergent. A suitable alkaline detergent is NATURAL ORANGE TM, which is available from Better Engineering Mfg., Inc. It is preferred that the cleaning solution be heated to a temperature in the range of 140° to 180° F. for optimal cleaning.

In the preferred embodiment of the invention, washer 100 has the following approximate dimensions:

Height of base 102-18"
Height of housing 106 (including lid 108)-29"
Distance between tank floor and cover plate 402-10"
Normal depth of cleaning solution-8"
Overall height of washer 100-47"
Width of washer 100-30"
Depth of washer 100-21"

These dimensions make hybrid washer 100 suitable for use in locations with limited floor space while still meeting the majority of a user's cleaning needs.

The invention has been described and illustrated with a certain degree of particularity. Nonetheless, it is understood that those skilled in the art will recognize a variety of applications and appropriate modifications within the spirit of the invention and the scope of the claims.

What is claimed is:

1. A recirculating parts washer which uses a water-based detergent cleaning solution for cleaning and degreasing a workpiece, the parts washer comprising:

tank means for storing a cleaning solution;

enclosure means, coupled to said tank means, for providing a wash area for the workpiece;

jet wash means, disposed within said enclosure means, for directing a plurality of streams of cleaning solution onto the workpiece;

brush wash means having a hose and a brush head, said brush wash means being adapted to receive a flow of cleaning solution through said hose and to deliver said flow of cleaning solution to said brush head for manually cleaning the workpiece disposed within said wash region; and pump means for drawing cleaning solution from said tank means and for selectively delivering a flow of cleaning solution to said jet wash means and/or said brush wash means, said pump means comprising a first pump adapted to supply the cleaning solution to said jet wash means, a second pump adapted to supply the cleaning solution to said brush wash means, and an election means for alternately enabling either said first pump or said second pump.

2. A recirculating parts washer which uses a water-based detergent cleaning solution for cleaning and degreasing a workpiece, the parts washer comprising:

tank means for storing a cleaning solution;

enclosure means, coupled to said tank means, for providing a wash area for the workpiece;

jet wash means, disposed within said enclosure means, for directing a plurality of streams of cleaning solution onto the workpiece;

brush wash means having a hose and a brush head, said brush wash means being adapted to receive a flow of cleaning solution through said hose and to deliver said flow of cleaning solution to said brush head for manually cleaning the workpiece disposed within said wash region; and pump means for drawing cleaning solution from said tank means and for selectively delivering a flow of cleaning solution to said jet wash means and/or said brush wash means, said pump means comprising a pump and a valve, said valve being operable to alternatively supply a flow of the cleaning solution to either the jet wash means or the brush wash means, said valve including a bleed means for diverting a portion of said flow from said brush wash means to said tank means.

3. The parts washer of claim 1, further comprising:

decontamination means for removing lighter than water contaminants from the cleaning solution stored in said tank means.

4. A parts washer comprising:

an enclosed washer housing having a tank region for storing a cleaning solution, a wash region disposed adjacent said tank region, an opening in said housing to allow a user access to said wash region, and a lid adapted to cover said opening;

support means for supporting a workpiece within said wash region;

first spray means, disposed in said wash region, for receiving a flow of cleaning solution and for directing said flow of cleaning solution toward the workpiece from a first direction;

second spray means, disposed in said wash region, for receiving a flow of cleaning solution and for directing said flow of cleaning solution toward the workpiece from a second direction, wherein said second direction is at least ninety degrees (90°) displaced from said first direction;

brush means, including a hose and a brush head, for receiving a flow of cleaning solution through said hose and for delivering said flow of cleaning solution to said brush head for manual cleaning of the workpiece; and pump means, coupled to said washer housing, for drawing cleaning solution from said tank region and for delivering a flow of cleaning solution to said spray means and/or said brush means, said pump means comprising a first pump adapted to supply the cleaning solution to said first and second spray means, a second pump adapted to supply the cleaning solution to said brush means, and an election means for alternately enabling either said first pump or said second pump.

5. A parts washer comprising:

an enclosed washer housing having a tank region for storing a cleaning solution, a wash region disposed adjacent said tank region, an opening in said housing to allow a user access to said wash region, and a lid adapted to cover said opening;

support means for supporting a workpiece within said wash region;

first spray means, disposed in said wash region, for receiving a flow of cleaning solution and for directing said flow of cleaning solution toward the workpiece from a first direction;

second spray means, disposed in said wash region, for receiving a flow of cleaning solution and for directing said flow of cleaning solution toward the workpiece from a second direction, wherein said second direction is at least ninety degrees (90°) displaced from said first direction;

brush means, including a hose and a brush head, for receiving a flow of cleaning solution through said hose and for delivering said flow of cleaning solution to said brush head for manual cleaning of the workpiece; and pump means, coupled to said washer housing, for drawing cleaning solution from said tank region and for delivering a flow of cleaning solution to said spray means and/or said brush means, said pump means comprising a pump and a valve, said valve being operable to alternatively supply a flow of the cleaning solution to either the first and second spray means or the brush means, said valve including a bleed means for diverting a portion of said flow from said brush means to said tank region.

6. The parts washer of claim 4, further comprising:

a cover plate disposed in said washer housing between said tank region and said wash region, said cover plate including a return opening for returning a flow of cleaning solution to said tank region following application of the cleaning solution to the workpiece.

7. The parts washer of claim 6, further comprising:

decontamination means for removing lighter than water contaminants from the cleaning solution.

8. The parts washer of claim 7, wherein said decontamination means comprises:

a trough formed at an edge of said cover plate;

a slot opening formed in said trough;

a drain opening disposed in a wall of said housing adjacent to said trough, said drain opening being adapted to remove liquids from said trough; and a catch box coupled to said housing near said drain opening to catch liquids which flow out of said drain opening.

9. A recirculating parts washer which uses a water-based detergent cleaning solution for cleaning and degreasing automotive parts and the like, the parts washer comprising:

an enclosed washer housing having a lower tank region for storing a cleaning solution, an upper wash region, an opening to allow a user access to said wash region, and a lid adapted to cover said opening, said housing being enclosed at the bottom by said tank and at the top by said lid;

a shelf, disposed within said washer housing above said tank region, to support a workpiece;

a first spray manifold, disposed in said wash region below said shelf, to receive a flow of cleaning solution and direct said flow of cleaning solution upwards toward the workpiece;

a second spray manifold, disposed in said washer housing in said lid, to receive a flow of cleaning solution and direct said flow of cleaning solution downwards toward the workpiece;

a brush assembly having a hose and a brush head, said brush assembly being adapted to receive a flow of cleaning solution through said hose and to deliver said flow of cleaning solution to said brush head for manual cleaning of the workpiece;

a first pump, coupled to said washer housing, to draw cleaning solution from said tank region and deliver a flow of cleaning solution to said first and second spray manifolds;

a second pump, coupled to said washer housing, to draw cleaning solution from said tank region and deliver a flow of cleaning solution to said brush assembly;

a switch to selectively enable only one of said first and second pumps to be operated at any one time; and an interlock to prevent said first pump from operating when said lid is in an open position.

* * * * *